US010036113B2

(12) United States Patent
Fitzgerald et al.

(10) Patent No.: US 10,036,113 B2
(45) Date of Patent: Jul. 31, 2018

(54) LAUNDRY TREATING APPLIANCE WITH EMBOSSED CONTAINER

(71) Applicant: Whirlpool Corporation, Benton Harbor, MI (US)

(72) Inventors: Gregg P. Fitzgerald, Eau Claire, MI (US); John M. Hunnell, Saint Joseph, MI (US); John W. McConnell, Saint Joseph, MI (US); Stephen D. Ostdiek, Saint Joseph, MI (US); Dean L. Tietz, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 803 days.

(21) Appl. No.: 13/947,326

(22) Filed: Jul. 22, 2013

(65) Prior Publication Data

US 2015/0020553 A1 Jan. 22, 2015

(51) Int. Cl.

| | |
|---|---|
| ***D06F 37/02*** | (2006.01) |
| ***D06F 37/26*** | (2006.01) |
| *D06F 23/04* | (2006.01) |

(52) U.S. Cl.

CPC ..... *D06F 37/264* (2013.01); *D06F 37/02* (2013.01); *D06F 23/04* (2013.01)

(58) Field of Classification Search

CPC ..... D06F 37/04; D06F 37/06; D06F 58/02; D06F 23/04; D06F 37/264; D06F 37/2645

See application file for complete search history.

(56) References Cited

U.S. PATENT DOCUMENTS

| | | | | |
|---|---|---|---|---|
| D652,591 | S | 1/2012 | Kim | |
| 8,181,355 | B2 | 5/2012 | Geyer et al. | |
| 2009/0211313 | A1 | 8/2009 | Exler et al. | |
| 2010/0287996 | A1 | 11/2010 | Geyer et al. | |
| 2010/0326142 | A1* | 12/2010 | Geyer | D06F 37/04 68/139 |
| 2011/0048080 | A1 | 3/2011 | Oertel et al. | |
| 2012/0024022 | A1* | 2/2012 | Geyer | D06F 58/04 68/212 |

FOREIGN PATENT DOCUMENTS

| | | | | |
|---|---|---|---|---|
| CN | 201024332 | Y | 2/2008 | |
| CN | 101532233 | A * | 9/2009 | D06F 23/00 |
| DE | 102005026175 | A1 | 12/2006 | |
| DE | 202008001230 | U1 | 5/2008 | |
| EP | 1028189 | A2 | 8/2000 | |
| EP | 1458919 | B1 | 3/2011 | |
| EP | 1925704 | B1 | 3/2011 | |

(Continued)

OTHER PUBLICATIONS

Machine English Translation of Description of CN101532233 A (Hosomi, Sep. 2009).*

(Continued)

*Primary Examiner* — Joseph L. Perrin
*Assistant Examiner* — Irina Graf

(57) ABSTRACT

A laundry treating appliance for treating laundry according to a cycle of operation, includes a container rotatable about a rotational axis and having a peripheral wall, a plurality of arranged embossments, and a plurality of arranged holes, wherein the plurality of embossments may be oriented at an angle to both of the rotational axis and the plurality of arranged holes.

16 Claims, 4 Drawing Sheets

(56) References Cited

FOREIGN PATENT DOCUMENTS

| | | | | | |
|---|---|---|---|---|---|
| EP | 2390399 | B1 | | 12/2012 | |
| JP | H08117485 | A | * | 5/1996 | ..... D06F 39/12 |
| JP | 2002172296 | A1 | * | 6/2002 | ..... D06F 39/12 |
| JP | 2008079762 | A | | 4/2008 | |
| KR | 20020093274 | A | | 12/2002 | |
| KR | 20030004554 | A | | 1/2003 | |
| KR | 100644823 | B1 | | 11/2006 | |
| SU | 1390275 | A1 | * | 4/1988 | ..... D06F 23/02 |

OTHER PUBLICATIONS

German Search Report for Counterpart DE102014107922.1, dated Feb. 5, 2015.

* cited by examiner

LAUNDRY TREATING APPLIANCE WITH EMBOSSED CONTAINER

BACKGROUND OF THE INVENTION

Laundry treating appliances, such as clothes washers, refreshers, clothes dryers, and non-aqueous systems, may have a configuration based on a rotating container, such as a basket or drum, that defines a treating chamber or container in which laundry items are placed for treating. The laundry treating appliance may have a controller that implements a number of pre-programmed cycles of operation. The user typically manually selects the cycle of operation from the given pre-programmed cycles. The controller then uses adjustable parameters of the selected pre-programmed cycle of operation to operate various components of the laundry treating appliance to complete the cycle, such as a wash cycle.

BRIEF DESCRIPTION OF THE INVENTION

In one aspect, a laundry treating appliance for treating laundry according to an automatic cycle of operation, includes a container rotatable about a rotational axis and having a peripheral wall and at least partially defining a treating chamber, a plurality of embossments provided on the peripheral wall and arranged in rows, with each embossment having an oblong shape defining a major body axis, and a plurality of holes formed in the peripheral wall and arranged in at least one row defining a row axis, wherein the major body axis is oriented at an angle to both of the rotational axis and at least one row axis.

DESCRIPTION OF EMBODIMENTS OF THE INVENTION

The invention may be implemented in any environment using a container rotatable about a rotational axis regardless of whether the container provides a treating chamber for a laundry treating appliance or not.

Figure 1:
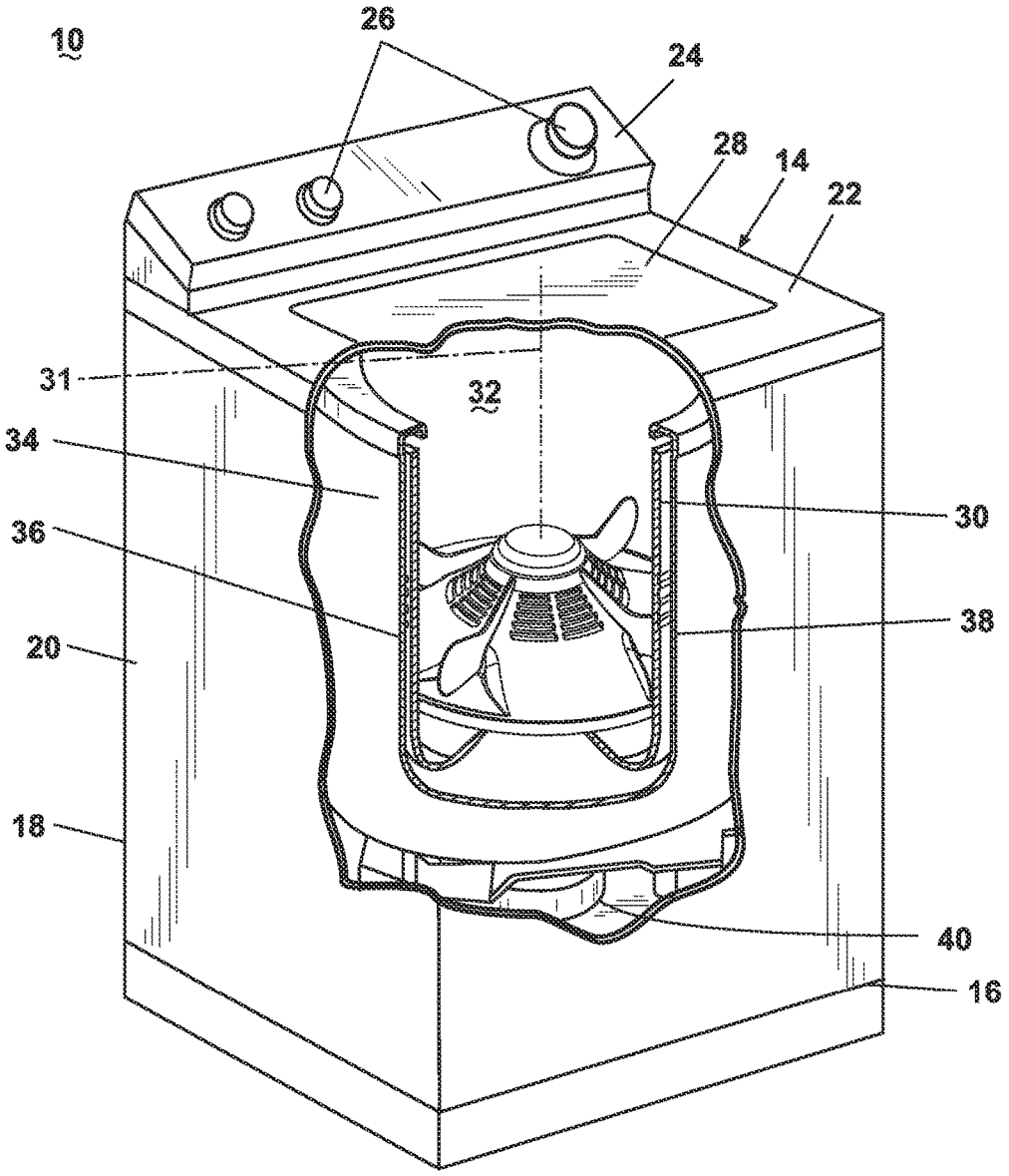
FIG. 1 is a perspective view of a laundry treating appliance according to one embodiment of the invention, with a portion cut-away to show interior components of the laundry treating appliance, including a container forming at least a portion of a laundry treating chamber for receiving laundry for treatment.

FIG. 1 is a perspective view of a laundry treating appliance 10 in the form of a washing machine according to one embodiment of the invention. The apparatus described herein may be used with any suitable laundry treating appliance and is not limited to use with washing machines, including the laundry treating appliance 10 described below and shown in the drawings. As illustrated, the laundry treating appliance 10 may be a vertical-axis washing machine; however, the laundry treating appliance 10 may be any appliance which performs an automatic or manual cycle of operation on laundry, non-limiting examples of which include a horizontal-axis washing machine; a horizontal or vertical axis clothes dryer; a combination washing machine and clothes dryer; a tumbling or stationary refreshing/revitalizing machine; an extractor; a non-aqueous washing apparatus; and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. The laundry treating appliance 10 described herein shares many features of a traditional automatic washing machine, which will not be described in detail except as necessary for a complete understanding of the invention. For illustrative purposes, the apparatus will be described with respect to a washing machine with one or more articles making up the load, with it being understood that the invention may be adapted for use with other types of laundry treating appliances.

As illustrated in FIG. 1, the laundry treating appliance 10 may have a cabinet 14 defined by a front wall 16, a rear wall 18, and a pair of side walls 20 supporting a top wall 22. A user interface 24 on the cabinet 14 has multiple controls 26, which a user may select to operate the laundry treating appliance 10 through the steps of a wash cycle. A chassis (not shown) may be provided, with the walls mounted to the chassis.

The top wall 22 may have an openable door or lid 28 and may be selectively moveable between opened and closed positions to close an opening in the top wall 22, which provides access to the interior of the cabinet 14. A container, such as a container 30, which is illustrated as a basket, may be disposed within the interior of the cabinet 14 and rotatable about a rotational axis 31. The container 30 at least partially defines a treating chamber 32 for treating laundry, and may be positioned within an imperforate tub 34. A clothes mover 38 may be located in the container 30 to impart mechanical agitation to a load of clothing articles placed in the container 30.

The container 30 and/or the clothes mover 38 may be driven by an electrical motor 40 operably connected to the container 30 and/or the clothes mover 38. The clothes mover 38 may be oscillated or rotated about the rotational axis 31 during a cycle of operation in order to produce high water turbulence effective to wash the load contained within the treating chamber 32. The motor 40 may rotate the container 30 at various speeds in either rotational direction. Additional optional components of the laundry treating appliance 10, for instance, a balance ring for the container 30, are envisioned.

Figure 2:
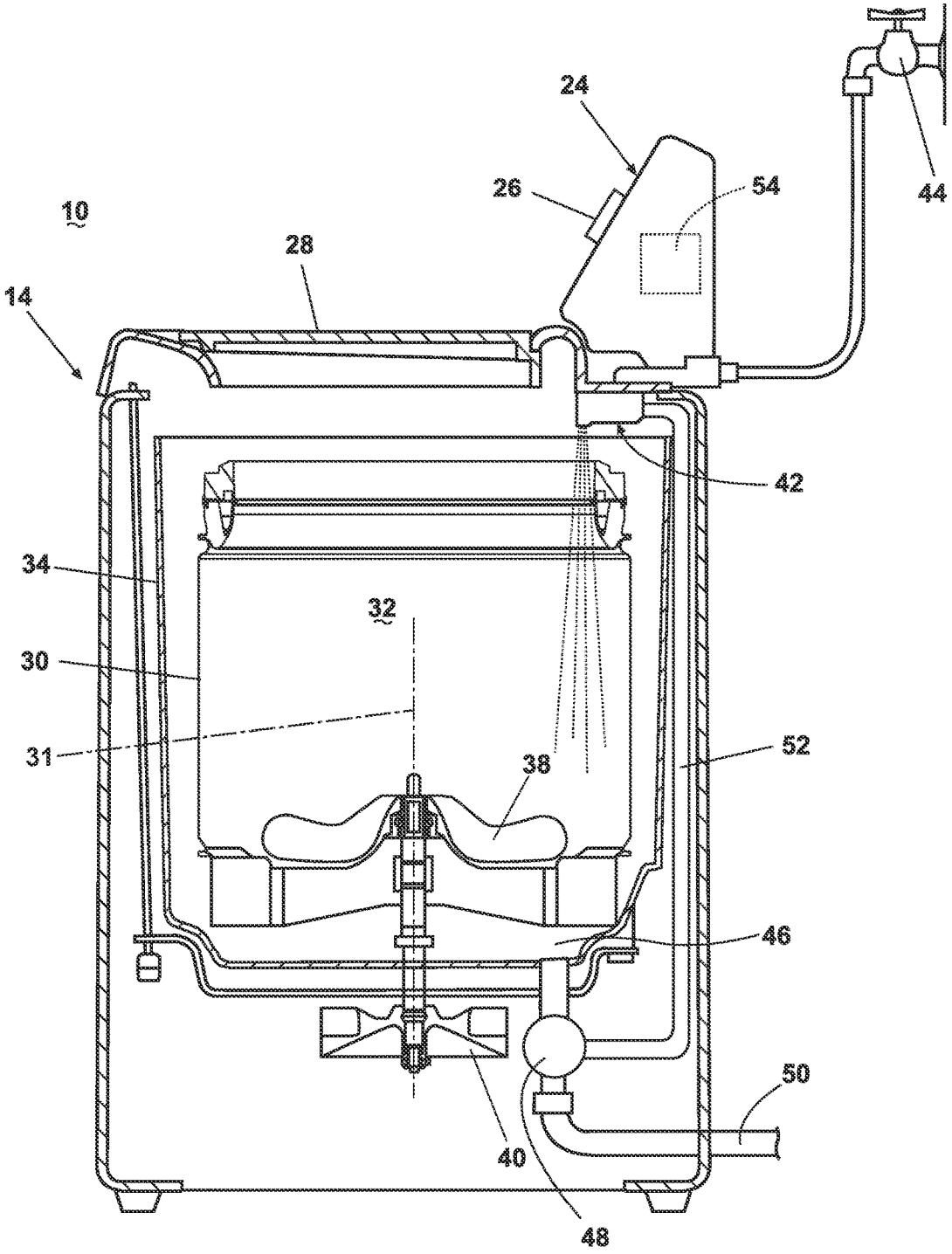
FIG. 2 is a schematic cross-sectional view of the interior components of the laundry treating appliance of FIG. 1, according to one embodiment of the invention.

FIG. 2 is a schematic cross-sectional view of the interior components of the laundry treating appliance of FIG. 1. A liquid supply and recirculation system 42 may be provided to spray treating liquid, such as water or a combination of water and one or more wash aids, such as detergent, into the open top of the container 30 and onto the top of a laundry load placed within the treating chamber 32. The liquid supply and recirculation system 42 may be configured to supply treating liquid directly from a household water supply 44 and/or from the tub 34 and spray it onto the fabric load. The liquid supply and recirculation system 42 may also be configured to recirculate treating liquid from the tub 34, including a sump 46, and spray it onto the top of the load. A pump 48 may be housed below the tub 34. The pump 48 may have an inlet fluidly coupled with the sump 46 and an outlet configured to fluidly couple with either or both a household drain 50 or a recirculation conduit 52. In this configuration, the pump 48 may be used to drain or recirculate wash water in the sump 46, which may be initially sprayed into the container 30, flows through the container 30, and then into the sump 46.

Additionally, the liquid supply and recirculation system 42 may differ from the configuration shown in FIG. 2, such as by inclusion of other valves, conduits, wash aid dispensers, pumps, heaters, sensors, such as water level sensors and temperature sensors, and the like, to control the flow of treating liquid through the laundry treating appliance 10 and for the introduction of more than one type of detergent/wash aid. Further, the liquid supply and recirculation system 42 need not include the recirculation portion of the system or may include other types of recirculation systems.

The laundry treating appliance 10 may further include a controller 54 coupled with various working components of the laundry treating appliance 10, such as the motor 40 and the pump 48, to control the operation of the working components. The controller 54 may receive data from one or more of the working components and may provide commands, which may be based on the received data, to one or more of the working components to execute a desired operation of the laundry treating appliance 10. The commands may be data and/or an electrical signal without data. The user interface 24 may be coupled with the controller 54 and may provide for input/output to/from the controller 54. In other words, the user interface 24 may allow a user to enter input related to the operation of the laundry treating appliance 10, such as selection and/or modification of an operation cycle of the laundry treating appliance 10, and receive output related to the operation of the laundry treating appliance 10.

Many known types of controllers may be used for the controller 54. The specific type of controller may not germane to the invention. It is contemplated that the controller 54 may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

The laundry treating appliance 10 may perform one or more manual or automatic treating cycles or cycle of operation and a common treating cycle includes a wash phase, a rinse phase, and a spin extraction phase. Other phases for treating cycles include, but are not limited to, intermediate extraction phases, such as between the wash and rinse phases, and a pre-wash phase preceding the wash phase, and some treating cycles include only a select one or more of these exemplary phases.

Figure 3:
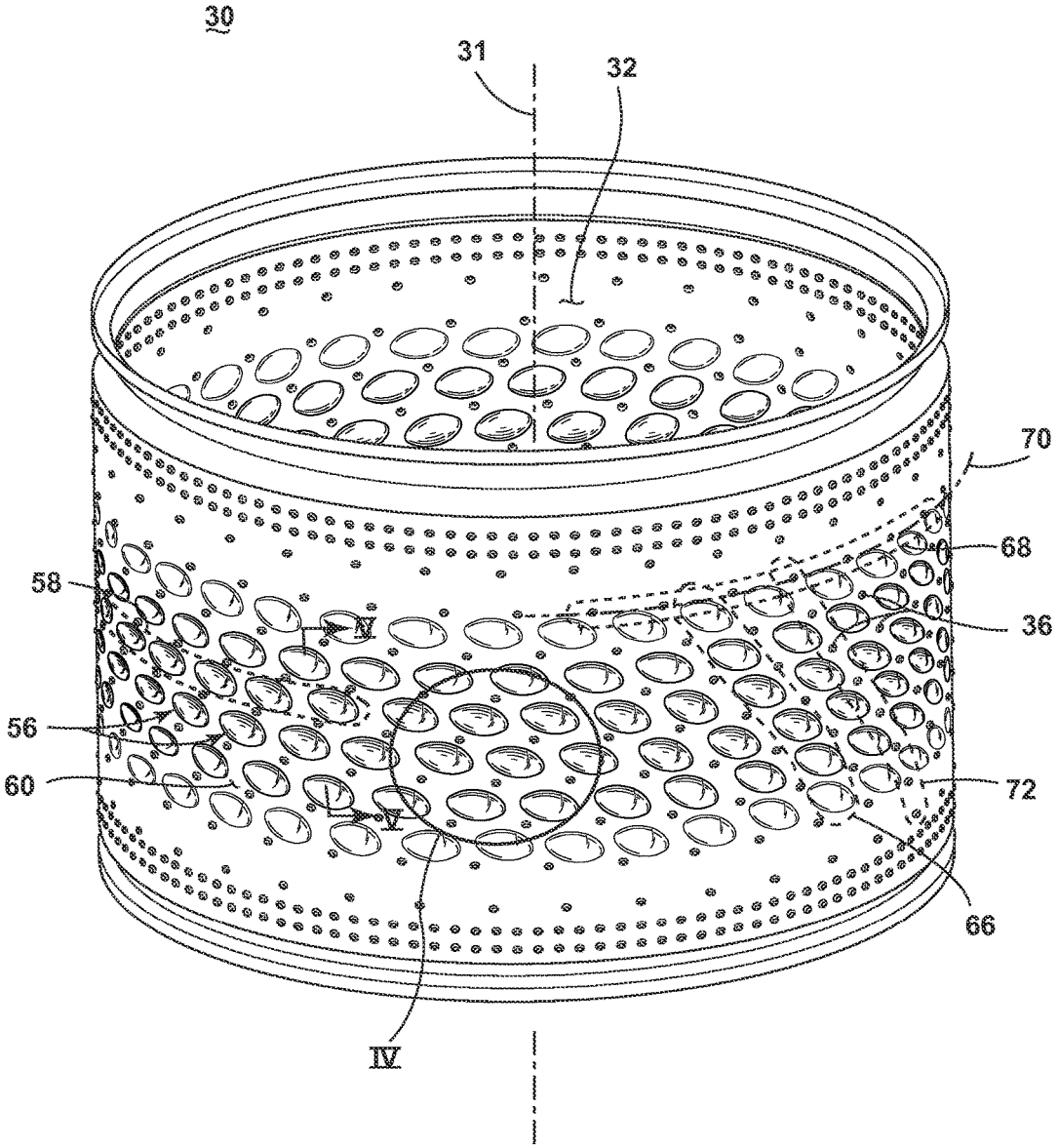
FIG. 3 is a perspective view of a sidewall of the container, including the embossments on the sidewall, according to one embodiment of the invention.

FIG. 3 illustrates a peripheral wall 60 of the container 30 for the laundry treating appliance 10, having a plurality of formed embossments 56, and may additionally have a plurality of perforations, such as holes 36. The embossments 56 are spatially separated and are formed such that they project into the treating chamber 32. The embossments 56 are arranged in rows 58, and may further define embossment columns 66 spanning the embossment rows 58, wherein the columns 66 are shown to slightly curve about the container 30 as they span the length of the rotational axis 31. Additionally, all of the embossment rows 58 and columns 66 are shown parallel to each other, but alternatively, only some embossment rows 58 or columns 66 may be parallel to other embossment rows 58 or columns 66. The embossments 56 may be, for example, mechanically formed, shaped, or molded on the peripheral wall 60.

The holes 36 are arranged and configured, such that liquid may flow between the tub 34 and the treating chamber 32 through the holes 36. As shown, the plurality of holes 36 are spatially separated and arranged in at least one hole row 68, with each hole row 68 defining a separate hole row axis 70. Each of the holes 36 of any one hole row 68 may be offset relative to holes 36 in immediately adjacent hole rows 68. All of the hole row axes 70 may be parallel to each other.

The holes 36 may further be arranged in hole rows 68 to define hole columns 72 spanning the hole rows 68, wherein the columns 72 are shown to slightly curve about the container 30 as they span the length of the rotational axis 31. Furthermore, all of the hole rows 68 and axes 70 may be parallel to all of the embossment rows 58. Alternatively, some of the hole rows 68 and axes 70 may be parallel to each other, or to only some embossment rows 58. Additionally, the hole columns 72 may be parallel to each other. The holes 36 may be, for example, mechanically formed, shaped, or molded on the peripheral wall 60. Alternate hole 36 patterns, or hole 36 patterns in addition to those described above, are envisioned. For instance, an additional hole 36 pattern may be envisioned along the axial ends of the container 30 for increased liquid flow between the tub 34 and the container 30. The embossment rows 58 and columns 66 are additionally illustrated interweaved with the respective hole rows 68 and hole columns 72.

Figure 4:
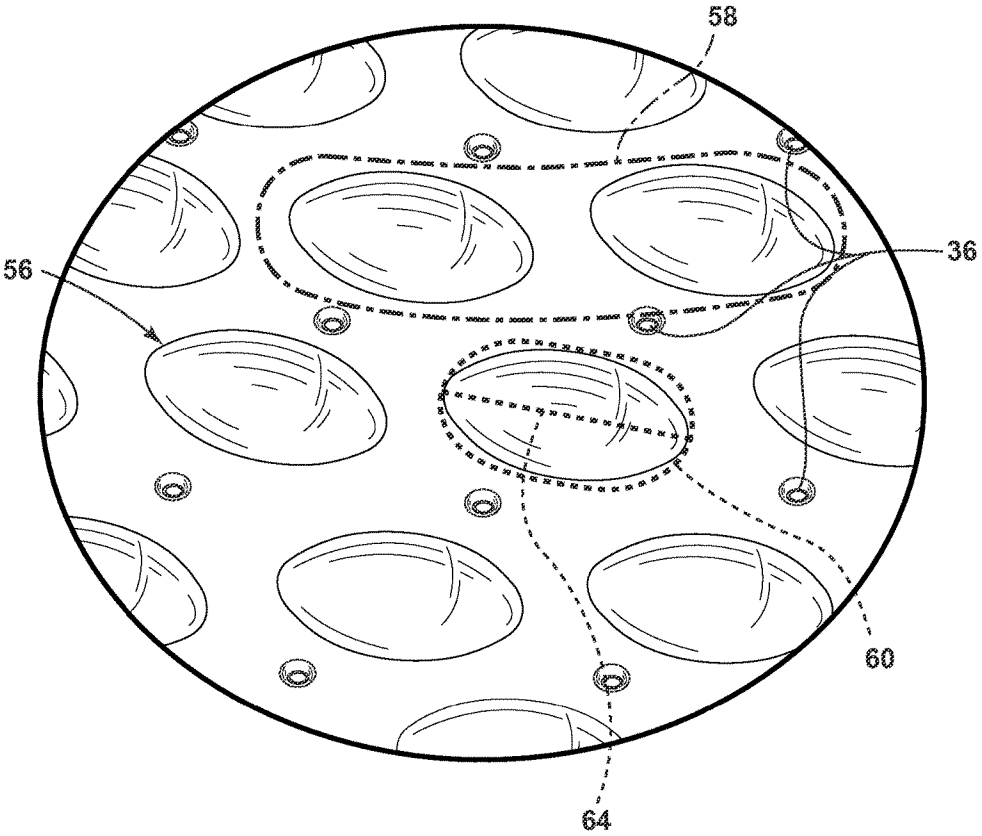
FIG. 4 is an enlarged detail section IV, showing a portion of the embossments of FIG. 3, according to one embodiment of the invention.

As shown in the enlarged detail section of FIG. 4, each embossment 56 has an oblong shape 62 defining a major body axis 64. Each of the embossments 56 of any one embossment row 58 may also be offset relative to embossments 56 in immediately adjacent embossment rows 58. The major body axis 64 of each embossment 56 may be oriented at an angle to both of the rotational axis 31 and at least one hole row axis 70. Additionally, it is envisioned that the orientation of the major body axis 64 may vary between each embossment rows 58. Alternate embossment shapes are envisioned, such as ovate shapes, rectilinear shapes, etc. Although the embossments 56 are shown with defined edges about the oblong shape 62, it is envisioned that, for example, when forming the embossments 56, the forming will leave the embossments 56 edges less defined, for instance, gradual transition from the embossment 56 to the peripheral wall 60.

Figure 5:
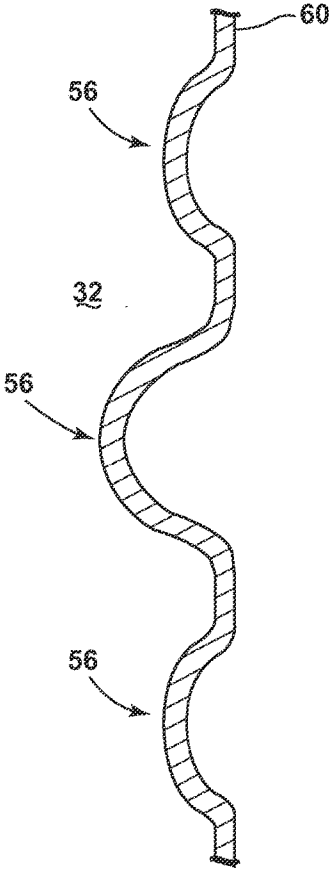
FIG. 5 is a partial sectional view taken along line 5-5 of FIG. 3, showing the height of the embossments of the container, according to one embodiment of the invention.

FIG. 5 illustrates a sectional view of the peripheral wall, showing that the height of the embossments 56 may be lower for the embossments 56 in the outermost embossment rows 58, relative to the embossments 56 of the innermost embossment rows 58. It is contemplate that the outermost rows 58 may emerge from the outer surface of the container and increase in height, on a per row basis, until they reach a maximum height at the middle row or rows.

Generally, in normal operation of the laundry treating appliance 10, a user places articles, such as clothing, into the treating chamber 32 of the laundry treating appliance 10. The user then selects an appropriate treating cycle for the articles, such as a wash cycle, via the user interface 24. Non-limiting examples of cycles of operation include normal, delicate, and heavy-duty. The cycle may be initiated automatically when the user closes the lid 28, or at the start of the user-selected treating cycle.

During the wash cycle, operation of the motor may accelerate the container 30 or clothes mover 38 individually, in unison, in opposing directions, or according to a predetermined alternating pattern to operably perform the selected cycle of operation. The interaction of the articles with the clothes mover 38, embossments 56, container 30, and liquid flowing in between the tub 34 and treating chamber 32 via the holes 36 causes agitation which loosens or removes unwanted soiling particles from the articles.

At the end of the wash cycle, or intermittently during the cycle of operation, the laundry treating appliance 10 may also perform a dehydrating operation to remove the water from the articles. During this operation, the liquid may be drained from the treating chamber 32 and the motor 40 spins the container 30 at a high rate of speed, causing satellization of the articles against the peripheral wall 60 of the container 30. The configuration of the embossments 56 and holes 36 allow for aligning the articles about the container 30 in a balanced arrangement and further dehydration, allowing additional liquid to be drawn out of the articles by centrifugal force. The wash and dehydration cycles may each occur for a predetermined time or a variable time, as calculated by the controller 54, based on sensed characteristics of the articles or other inputs.

Many other possible embodiments and configurations in addition to that shown in the above figures are contemplated by the present disclosure. For example, one embodiment of the invention contemplates a horizontal axis laundry treating appliance 10. Another embodiment of the invention contemplates formed embossments 56 that project away from the treating chamber 32. Additionally, the design and placement of the various components may be rearranged such that a number of different in-line configurations could be realized.

The embodiments disclosed herein provide a laundry treating appliance with an embossed drum configuration. One advantage that may be realized in the above embodiments is that the above described embodiments provide for improved cycle performance of the laundry treating appliance due to the improved interaction between the articles and the drum. Additionally, the above-described embodiments provide for improved water extraction during the dehydrating operation. Another advantage that may be realized in the above embodiments is an improved load balancing during satellization, and a lower speed needed to perform satellization of the articles, during the dehydrating operation. The improved balancing and water extraction allow the motor to operate at lower speeds during the dehydrating operation, improving motor reliability. Alternatively, the improved balancing and water extraction may allow the motor to operate at higher speeds during the dehydrating operation, reducing the time needed for the dehydrating operating and reducing the overall time to complete the cycle of operation. Yet another advantage that may be realized in the above embodiments is that the configuration of the drum provides for an improved cleaning agitation during the wash cycle while providing a gentler interaction with the articles of clothing, resulting in an increased longevity of the effective article life.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. The primary differences among the exemplary embodiments relate to the configuration and pattern of embossments and hole of the drum, and these features may be combined in any suitable manner to modify the above described embodiments and create other embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance comprising:

a container rotatable about a rotational axis and having a peripheral wall defining a circumference for the container and terminating in axially spaced first and second axial edges;

a plurality of embossments projecting inwardly toward the rotational axis and provided on the peripheral wall and arranged in multiple axially-spaced circumferential embossment rows, including axially outermost embossment rows and axially innermost embossment rows, wherein the distance of the axially innermost embossment rows from the first or second axial edge is greater than the distance of the axially outermost embossment rows from the first or second axial edge;

a plurality of holes provided on the peripheral wall at locations spatially separate from the embossments and outside the embossment rows, and arranged in multiple axially-spaced circumferential hole rows;

wherein the embossments in any one of the embossment rows is circumferentially offset relative to the embossments in immediately adjacent embossment rows;

wherein the holes of any one of the hole rows is circumferentially offset relative to the holes in immediately adjacent hole rows;

wherein the height of the embossments in the embossment rows increases with the distance from the first or second axial edge such that the embossments in the axially outermost rows have a lower height than the embossments in the axially innermost rows, which have a higher height, and wherein the lower height embossments in the axially outermost rows have the same size as the higher height embossments in the axially innermost rows.

2. The laundry treating appliance of claim 1 wherein each of the multiple axially-spaced circumferential hole rows defines a separate hole row axis.

3. The laundry treating appliance of claim 2 wherein all of the hole row axes are parallel with the other hole row axes, and all of the embossment rows are parallel with the other embossment rows.

4. The laundry treating appliance of claim 3 wherein each of the embossments of any one embossment row is offset relative to the embossments in immediately adjacent embossment rows, and each of the holes of any one hole row is offset relative to holes in immediately adjacent hole rows.

5. The laundry treating appliance of claim 2 wherein each embossment has an oblong shape defining a major body axis oriented at an angle to both of the rotational axis and the hole row axis.

6. The laundry treating appliance of claim 2 wherein the hole row axis is defined by a respective plane orthogonal to the rotational axis.

7. The laundry treating appliance of claim 1 wherein the embossments are arranged in the embossment rows to define embossment columns spanning the embossment rows, and the holes are arranged in the hole rows to define hole columns spanning the hole rows.

8. The laundry treating appliance of claim 7 wherein the embossment columns and the hole columns are curved.

9. The laundry treating appliance of claim 8 wherein the curve of at least one of the embossment columns or the hole columns is S-shaped relative to the rotational axis.

10. The laundry treating appliance of claim 1 wherein the embossments are spatially separated from each other.

11. The laundry treating appliance of claim 1 wherein the embossments are ovate in shape.

12. The laundry treating appliance of claim 1 wherein the rotational axis is at least one of a horizontal axis and a vertical axis.

13. The laundry treating appliance of claim 1 wherein each of the embossments of any one embossment row is offset relative to the embossments in immediately adjacent embossment rows.

14. The laundry treating appliance of claim 1 wherein the height of the embossments in any one of the axially outermost embossment rows is lower than the height of the embossments in any one of the axially innermost embossment rows.

15. The laundry treating appliance of claim 1, wherein the embossment rows form at least one embossment column and the hole rows form at least one hole column, and at least one of the at least one embossment columns or the at least one hole columns is S-shaped relative to the rotational axis.

16. The laundry treating appliance of claim 1 wherein the lower height embossments in the axially outermost rows have the same circumference as the higher height embossments in the axially innermost rows.

* * * * *